US005795193A

United States Patent [19]

Yang

[11] Patent Number: 5,795,193

[45] Date of Patent: Aug. 18, 1998

[54] POWER DISTRIBUTION BOX WITH BUSBAR HAVING BOLT RETAINING MEANS

[75] Inventor: Shenghua Yang, Westland, Mich.

[73] Assignee: Yazaki Corporation, Tokyo, Japan

[21] Appl. No.: 736,071

[22] Filed: Oct. 23, 1996

[51] Int. Cl.[6] ..... H01R 13/68

[52] U.S. Cl. ..... 439/621; 439/723

[58] Field of Search ..... 439/621, 622, 439/721–724, 212

[56] References Cited

U.S. PATENT DOCUMENTS 4,273,408 6/1981 Orr ..... 439/723

4,432,594 2/1984 Daggett ..... 439/723

5,088,940 2/1992 Saito ..... 439/621

*Primary Examiner*—Gary F. Paumen

*Attorney, Agent, or Firm*—Young & Basile, P.C.

[57] ABSTRACT

A power distribution box (PDB) such as for use in an automotive vehicle, has a busbar adapted to retain a power connection bolt in connection with the busbar, thus permitting the busbar/bolt combination to be inserted from below into an operative position within the PDB housing. This results in the busbar and the bolt being securable within the PDB housing without the need for more costly alternatives such as insert molding or separate fabrication of a receptacle block. The busbar includes a generally U-shaped bolt retention bracket with latch tabs projecting inwardly to engage the bolt head and hold the bolt captive within the bracket.

10 Claims, 3 Drawing Sheets

10
12
14
16
18
20
22
24
26
28
30
32a
32b
34
36
38
40
42
48
50
52
54
56
76
78
2
4

POWER DISTRIBUTION BOX WITH BUSBAR HAVING BOLT RETAINING MEANS

FIELD OF THE INVENTION

This invention relates in general to power distribution boxes such as those used in automotive vehicle electrical systems, and more specifically to a busbar for use in such a power distribution box and having means for retaining a power connection bolt in captive engagement therewith.

BACKGROUND OF THE INVENTION

Power distribution boxes (PDBs) are commonly used in automotive vehicles to simplify electrical system wiring by eliminating multi-branch wiring and consolidating fuses, relays, and other electrical components in a single location. A PDB typically comprises a housing having a plurality of integrally formed external receptacles for receiving electrical connectors, fuses, relays, and other components. A busbar is contained within the housing and is supplied with electrical power by a main power cable leading to the vehicle alternator and/or battery. The busbar has a plurality of blade-like terminals which extend into some or all of the receptacles in order to make contact with and distribute power to the components inserted therein.

In one known PDB, the housing is formed as separate upper and lower segments which fit together to enclose the busbar. Receptacles are formed on the top or exterior surface of the upper segment, and a bolt is molded into the interior of the lower segment so as to project upwardly. To assemble the PDB, the busbar is inserted into the upper housing segment from below, then the upper and lower housing segments are mated such that the bolt extends upwardly through a hole in the busbar and is accessible through an opening in the top surface of the housing. The main power cable is secured into connection with the busbar by placing an eyelet terminal at the end of the cable over the bolt so as to contact a surface of the busbar, and threading a nut down over the bolt. The insert molding process used to fix the bolt in the lower housing segment increases the manufacturing cost of this type of PDB.

In another known type of PDB, a cavity is formed in the upper surface of the housing adjacent the receptacles, the cavity adapted to receive the power connection bolt such that the bolt head is supported from below and the threaded shank projects upwardly. The busbar fits downwardly into the housing, passing through slots formed therein so as to be received/contained within the housing. As the busbar is inserted into the housing in this manner, the bolt shank passes through a hole in the busbar and is exposed thereabove for connection with the power cable. An example of such a PDB is disclosed in U.S. Pat. No. 5,088,940.

Some of the electrical components received by the PDB receptacles have male blade terminals, and so cannot be connected directly with the busbar's blade terminals. The so-called "mini-fuses" widely used in automotive vehicles are examples of such components. For such components, mating connection is achieved by a female-female link terminal having a first end which fits downwardly over the busbar blade terminal, and a second end which receives the blade of the electrical component when it is inserted downwardly into the receptacle. If such link terminals are used in combination with a PDB having a busbar that is inserted into the PDB from above, some means must be provided to retain the link terminals in connection with the busbar blades and prevent them from being pulled out of the receptacle along with the electrical components if the components are disconnected from the PDB. The link terminals may be retained in their receptacles by molding the receptacles to include internal latching tabs which snap into engagement with the link terminals when they are properly positioned within their respective receptacles. Such latching tabs are disclosed in the '940 patent referred to above. Alternatively, a receptacle block may be molded separately from the housing and attached to the top surface of the PDB housing to enclose the link terminals after they and the busbar are inserted into the PDB. Both of these options result in increased complexity of the tooling and methods used to fabricate the PDB, and hence increase the production cost.

SUMMARY OF THE INVENTION

It is an objective of the present invention to reduce the complexity and production cost of a PDB. In general, this is achieved by providing a PDB having a busbar with means thereon for retaining a bolt in connection with the busbar, thus permitting the busbar/bolt combination to be inserted from below into an operative position within the PDB housing. This results in the busbar and the bolt being securable within the PDB housing without the need for more costly alternatives such as insert molding or separate fabrication of a receptacle block.

According to the invention, the busbar includes a generally U-shaped bolt retention bracket comprising two substantially parallel side plates connected by an end plate. The end plate has a hole formed therein, and the side plates are spaced from one another to permit insertion of the power connection bolt into the bracket such that the head of the bolt is sandwiched between the side plates and the bolt shank passes through the hole in the end plate. Latch tabs are formed integrally with the side plates and are bent inwardly therefrom to project into the interior of the bracket and angle toward the end plate. As the bolt shank is inserted through the hole in the end plate, the bolt head comes into contact with the latch tabs. Further urging of the bolt into the bracket deflects the tabs outwardly to permit the bolt head to slide past them. When the bolt reaches its fully inserted position, with the bolt head contacting the end plate, the bolt head has passed clear of the latch tabs and the tabs spring back to their undeflected positions to engage the bolt head and hold the bolt captive within the bracket.

According to a further feature of the invention, apertures are formed in either of the side plates and locking arms are disposed on the interior of a channel in the housing which receives the bracket when the PDB is assembled. The locking arms engage the apertures to secure the bracket within the housing.

DETAILED DESCRIPTION OF THE PREFERRED EMBODIMENT

Figure 1:
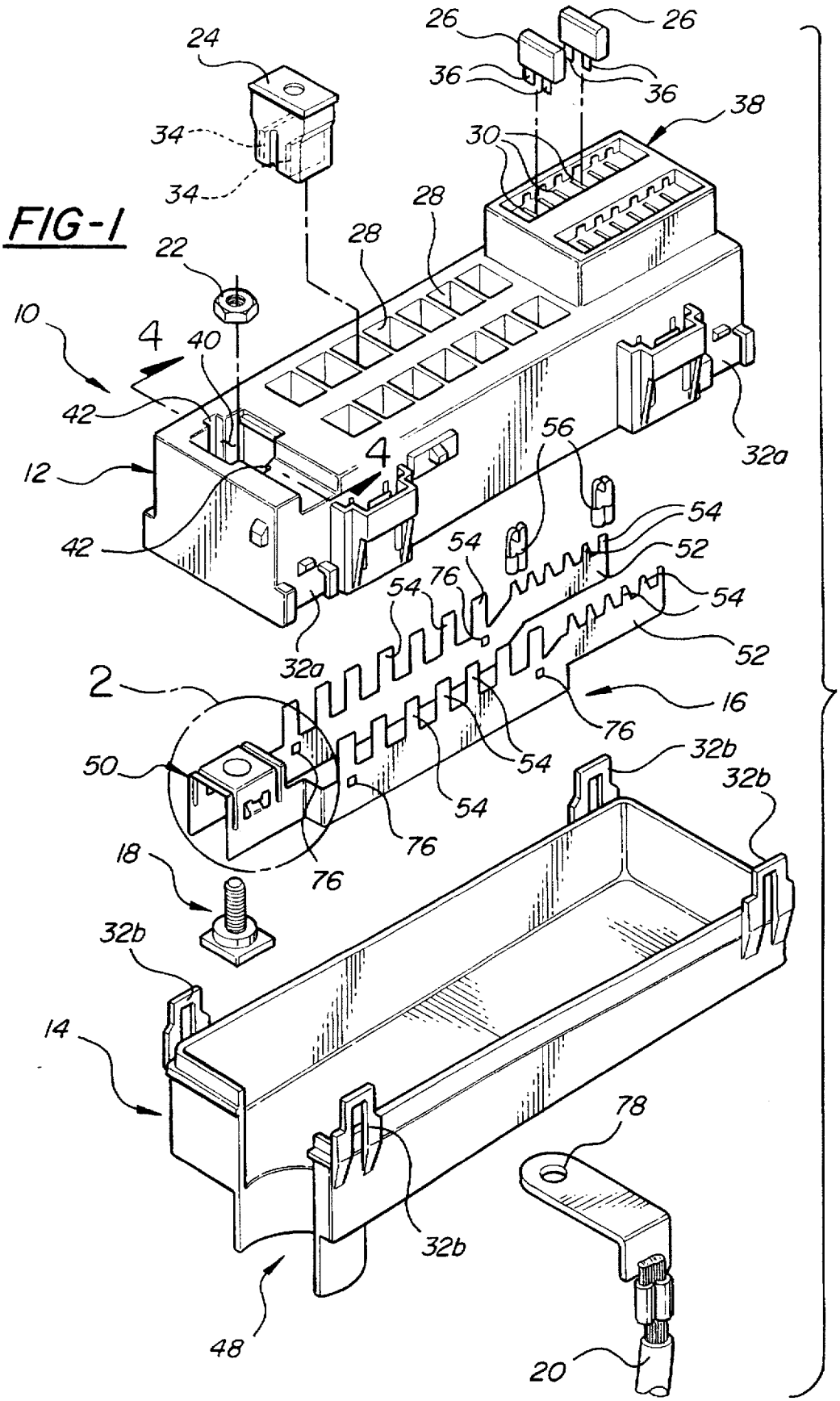
FIG. 1 is an exploded perspective view of the invention power distribution box.
Figure 2:
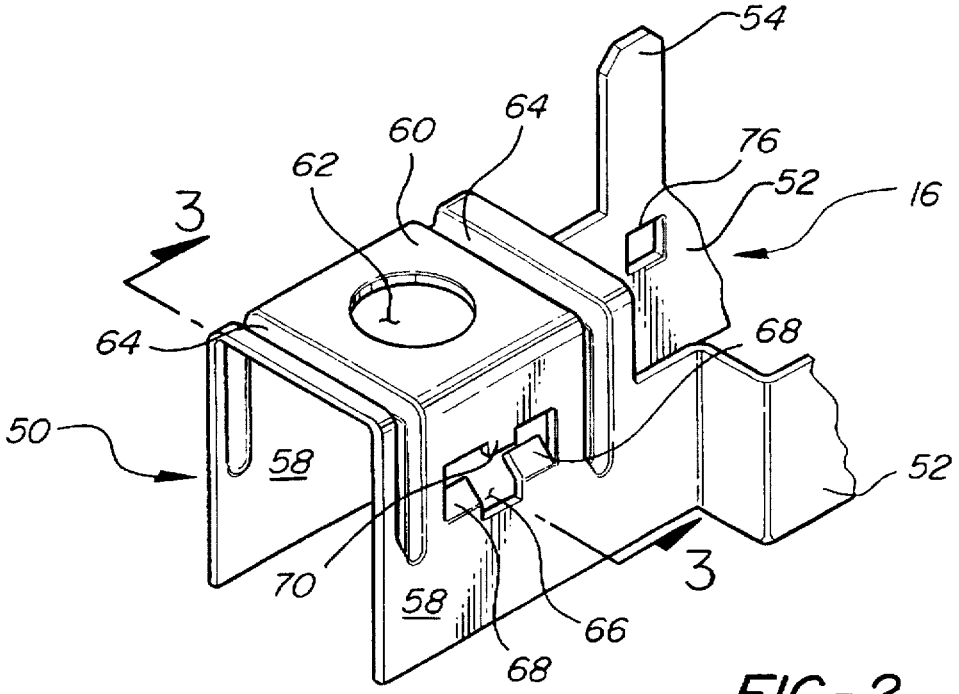
FIG. 2 is a detail of the busbar of the PDB of FIG. 1 showing the bolt retention bracket.

Referring to FIG. 1, a power distribution box (PDB) 10 according to the present invention comprises an upper housing 12, a lower housing 14 and a busbar 16. PDB 10 is commonly fitted with a protective top cover (not shown). Upper and lower housings 12, 14 fit into mating engagement with one another to enclose busbar 16 such that a power connection bolt 18 attached to busbar 16 is accessible from the top surface of upper housing 12. A power cable 20 is fastened into electrical contact with busbar 16 by means of power connection bolt 18 and nut 22, the cable supplying the busbar with electrical power. Fuses 24, 26 are inserted into receptacles 28, 30 formed on upper housing 12 to make electrical contact with busbar 16. It is possible for PDB 10 to include more than one busbar 16, each carrying a different level of current.

Upper and lower housings 12, 14 are preferably injection molded from a thermoplastic material and have complimentary locking means 32*a*, 32*b* formed integrally therewith for securing the two portions together. Receptacles 28 are sized to receive large fuses 24 having female terminals 34, while receptacles 30 are smaller and configured to receive mini-fuses 26 having male blade terminals 36. Mini-fuse receptacles 30 make up a mini-fuse insertion block 38 located at a first end of upper housing 12 and projecting above the top surface of the upper housing 12. It should be noted that in some PDBs, insertion block 38 does not project above the top surface of the upper housing.

Figure 4:
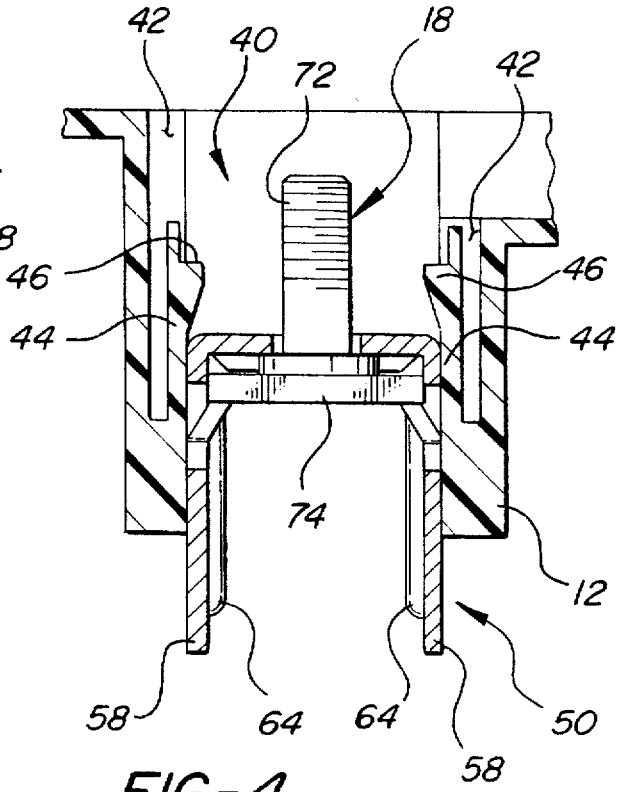
FIG. 4 is a cross-sectional view taken along line 4—4 of FIG. 1 showing the bolt retention bracket being inserted into the upper housing segment.
Figure 5:
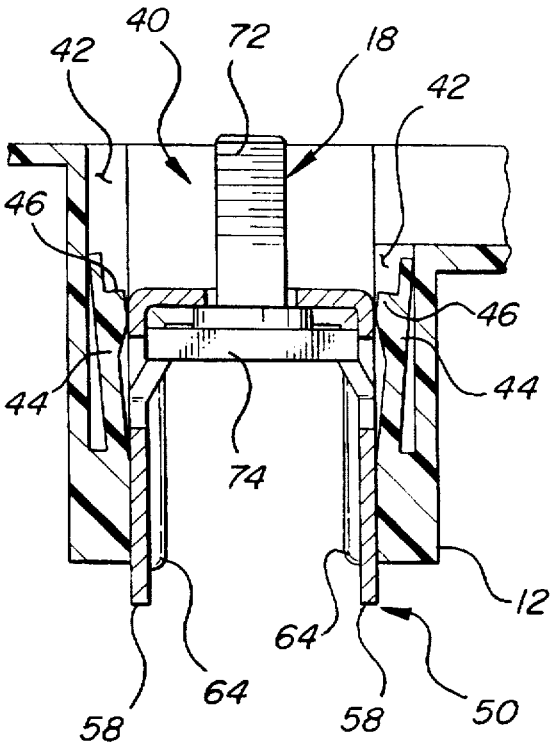
FIG. 5 is a view similar to FIG. 4, but showing the bracket contacting and deflecting locking arms of the upper housing segment.
Figure 6:
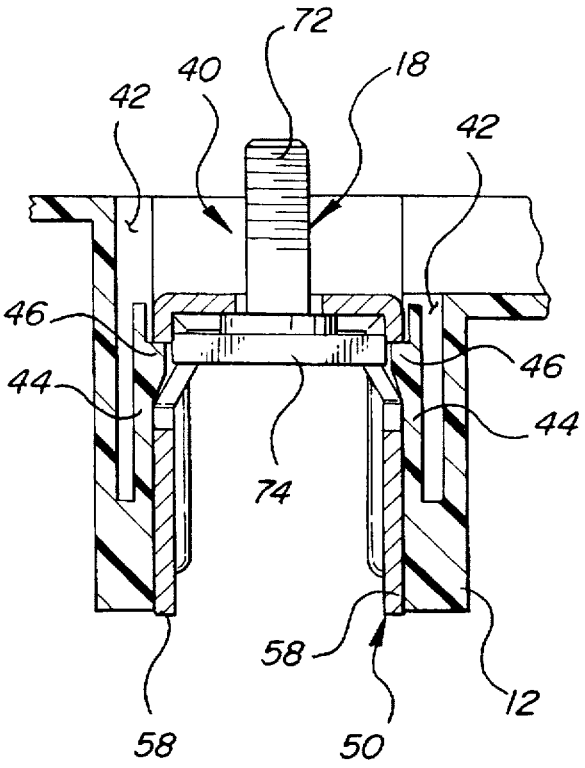
FIG. 6 is a cross-sectional view similar to FIGS. 4 and 5, but showing the bracket engaged with the locking arms.

An opening 40 passes through upper housing 12 adjacent a second end of the upper housing 12. Opening 40 is generally square in cross-section and has a pair of vertically extending channels 42 formed in opposite interior sidewalls thereof. As best seen in FIGS. 4–6, a locking arm 44 is disposed in each channel 42, the arms 44 extending upwardly and having an inwardly projecting barb 46 adjacent their upper ends. Lower housing 14 has a semi-circular opening 48 in its bottom surface to provide a passage for additional wiring connections (not shown) with the interior of PDB 10.

Busbar 16 is formed by a conventionally known stamping process from a thin sheet of conductive metal such as zinc or tin plated copper. Busbar 16 comprises a bolt retention bracket 50 and first and second arms 52 extending therefrom. Each arm 52 is formed with a plurality of upwardly projecting terminal blades 54, the blades at the end of arms 52 opposite from bracket 50 being smaller than those along the rest of the arms so as to match the size of mini-fuse receptacles 30. Female-female link terminals 56 of conventional design are provided and fit over the terminal blades 54 which correspond to the mini-fuse receptacles 30.

Figure 3:
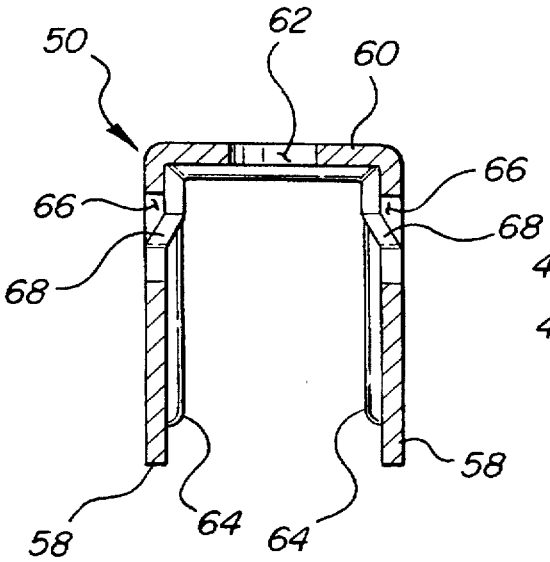
FIG. 3 is a cross-section taken along line 3—3 of FIG. 2.

Bracket 50 comprises a pair of spaced, parallel side plates 58 contiguous with arms 52, and an end plate 60 substantially perpendicular thereto. End plate 60 has a bolt hole 62 formed therein and a pair of stiffening ribs 64 extending across the width of end plate 60 and partially down side plates 58. Each side plate 58 has an aperture 66 formed therein and a pair of latch tabs 68 are located within each aperture 66 adjacent the edges thereof. Latch tabs 68 are bent to project inwardly from the planes of their respective side plates 58 and upwardly toward end plate 60, as best seen in FIG. 3. A projection 70 extends downwardly into aperture 66 from the center of the top edge of each aperture between latch tabs 68. Bracket 50 may also be formed with only one latch tab 68 projecting from each side plate 58, the single latch tab extending either partially or fully across the width of its respective aperture 66.

Power connection bolt 18 has a threaded shank 72 extending from a square head 74 having a width, flat-to-flat, of slightly less than the distance between the side plates 58 of the bracket 50. Bolt 18 is preferably formed from a metal having good electrical conductivity and corrosion resistance, such as brass. Of these two properties, corrosion resistance is the most important.

To assemble PDB 10, link terminals 56 are placed over the appropriate terminal blades 54 and power connection bolt 18 is inserted through bolt hole 62 from below. As bolt shank 72 passes through bolt hole 62, bolt head 74 slides freely between side plates 58 until coming into contact with latch tabs 68. Further urging of bolt 18 into bracket 50 causes bolt head 74 to deflect latch tabs 68 outwardly towards side plates 58 as the bolt head 74 passes therebetween. Latch tabs 68 are sufficiently resilient to snap back to their undeflected, inwardly angled positions after bolt head 74 has passed beyond them. Side plates 58 may also deflect or bow outwardly somewhat to permit passage of bolt head 74 between tabs 68, stiffening ribs 64 adding sufficient stiffness to the side plates to prevent them from remaining permanently in an outwardly bowed condition. When tabs 68 have returned to their undeflected positions, the upper edges thereof impinge upon the bolt head 74 to retain the bolt 18 in captive engagement with bracket 50, as depicted in FIGS. 4–6.

Busbar 16 is then inserted into the lower side of upper housing 12 such that bracket 50 is received by opening 40 and terminal blades 54 and link terminals 56 pass upwardly into their respective receptacles. As bracket 50 is inserted into opening 40, the upper end of the bracket 50 comes into contact with barbs 46 on locking arms 44 (see FIG. 4). Further urging of bracket 50 into opening 40 causes locking arms 44 to be deflected outwardly as seen in FIG. 5. When busbar 16 reaches its fully inserted position, locking arms 44 snap back inwardly such that barbs 46 engage projections 70 within apertures 66 to securely retain bracket 50 within opening 40, as seen in FIG. 6. The distance which projections 70 extend into apertures 66 depends upon the dimensions of lock arms 44 and barbs 46. If lock arms 44 are designed to engage the top edges of apertures 66 when bracket 50 is properly positioned in opening 40, the need for projections 70 is eliminated.

Busbar 16 may have additional apertures 76 (see FIG. 1) formed therein at various locations along its length, the apertures being engaged by locking means (not shown) within upper housing 12 to further secure the busbar 16 in its operative position. If the engagement between apertures 76 and their cooperating locking means is sufficiently secure to hold busbar firmly in place within housing 12, lock arms 44 would not be necessary and could be deleted from the housing. Upper and lower housings 12, 14 are then secured together by snapping locking means 32*a*, 32*b* into engagement with one another.

When busbar 16 is captively engaged by PDB 10 as described above, power connection bolt shank 72 projects upwardly from the top side of upper housing 12 such that an eyelet terminal 78 of power cable 20 may be placed over the shank 72 and fastened into contact with end plate 60 by tightening nut 22 down onto the shank 72.

Figure 7:
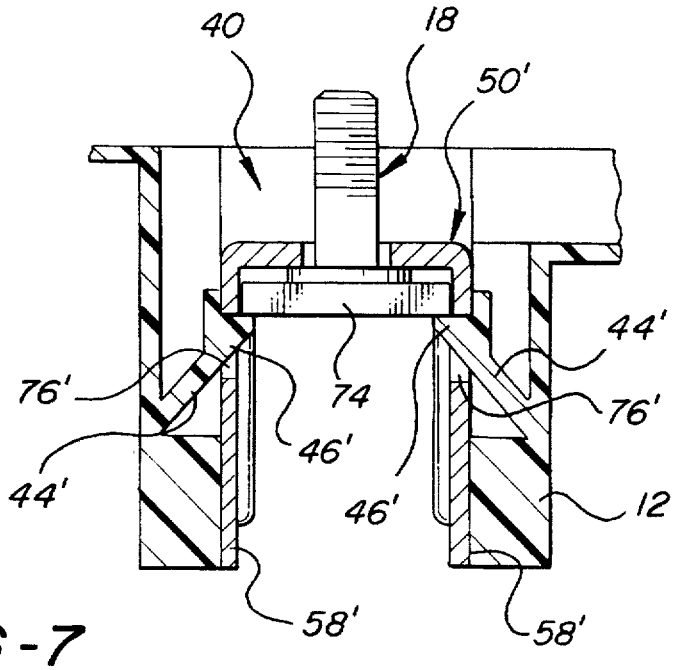
FIG. 7 shows an alternative embodiment of the invention wherein the locking arms of the housing engage both the bracket and the bolt head.

An alternative embodiment of the invention, shown in FIG. 7, features a busbar bracket 50' having apertures 76' passing through its side plates 58' but with no latch tabs as are present in the previously described embodiment. In the FIG. 7 embodiment, barbs 46' of latch arms 44' are long enough to extend completely through apertures 76' and engage bolt head 74. Channels 42' are deeper than in the previously described embodiment, because latch arms 44' must deflect outwardly a greater distance as bracket 50' passes through opening 40. Latch arms 44' serve a dual function, retaining bolt 18 properly positioned with respect to bracket 50' as well as securing the bracket within opening 40, thus doing away with the need for latch tabs on the bracket.

Whereas a preferred embodiment of the invention has been illustrated and described in detail, it will be apparent that various changes may be made in the disclosed embodiment without departing from the scope or spirit of the invention.

The invention claimed is:

1. A power distribution box comprising:

a housing;

a busbar for mounting within the housing; and means disposed on the busbar for retaining a power connection bolt in captive engagement with the busbar;

wherein the busbar has a bracket comprising first and second substantially parallel side plates and an end plate connecting the side plates and having a bolt hole formed therein, and the bolt retaining means is disposed on the bracket and adapted to hold the bolt in a captive position wherein a head of the bolt is between the side plates and a shank of the bolt passes through the bolt hole.

2. A power distribution box according to claim 1 wherein the bolt retaining means comprises at least one latch tab formed integrally with each of the side plates, the latch tabs projecting from their respective side plates to contact the bolt head when the bolt is in the captive position, said contact inhibiting withdrawal of the bolt from the captive position.

3. A power distribution box according to claim 2 wherein each side plate has at least one aperture formed therein and the housing has securing means disposed thereon for engaging the apertures to secure the bracket within the housing.

4. A power distribution box according to claim 3 wherein the latch tabs are formed adjacent edges of the apertures.

5. A power distribution box according to claim 3 wherein the housing further comprises an opening for receiving the bracket and the securing means comprises locking arms projecting into the opening.

6. A power distribution box according to claim 1 wherein the busbar has first and second arms formed integrally with and extending from the first and second side plates respectively.

7. A power distribution box comprising:

a busbar having a bracket comprising first and second substantially parallel side plates and an end plate connecting the side plates, the bracket adapted to receive a bolt in a captive position wherein a head of the bolt is between the side plates and a shank of the bolt projects through a hole formed in the end plate;

an aperture formed in each of the side plates;

at least one latch tab formed integrally with each of the side plates adjacent edges of the apertures, the latch tabs projecting from their respective side plates to contact the bolt head when the bolt is in the captive position, said contact inhibiting withdrawal of the bolt from the captive position;

a housing having an opening for receiving the bracket; and locking arms disposed on the housing and projecting into the opening, the locking arms engagable with the apertures to secure the busbar within the housing.

8. A power distribution box comprising:

a busbar having a bracket comprising first and second substantially parallel side plates and an end plate connecting the side plates, the bracket adapted to receive a bolt in a captive position wherein a head of the bolt is between the side plates and a shank of the bolt projects through a hole formed in the end plate;

an aperture formed in each of the side plates;

a housing having an opening for receiving the bracket; and locking arms disposed on the housing and projecting into the opening and through the apertures, the locking arms engagable with the apertures and the bolt head to secure the busbar and the bolt within the housing.

9. A busbar for use in an electrical power distribution box, the busbar having means for retaining a power connection bolt in captive engagement with the busbar, the busbar having a bracket comprising first and second substantially parallel side plates and an end plate connecting the side plates and having a bolt hole formed therein, and the bolt retaining means is disposed on the bracket and adapted to hold the bolt in a captive position wherein a head of the bolt is between the side plates and a shank of the bolt passes through the bolt hole.

10. A busbar according to claim 9 wherein the bolt retaining means comprises at least one latch tab formed integrally with each of the side plates, the latch tabs projecting from their respective side plates to contact the bolt head when the bolt is in the captive position, said contact inhibiting withdrawal of the bolt from the captive position.

* * * * *